US006546571B2

(12) United States Patent
Samelson

(10) Patent No.: US 6,546,571 B2
(45) Date of Patent: Apr. 15, 2003

(54) RE-ENFORCED SHOWER CURTAIN LINER AND METHOD FOR FABRICATING SAME

(75) Inventor: David Samelson, Morristown, NJ (US)

(73) Assignee: Ex-Cell Home Fashions, Inc., New York, NY (US)

( * ) Notice: Subject to any disclaimer, the term of this patent is extended or adjusted under 35 U.S.C. 154(b) by 0 days.

(21) Appl. No.: 09/902,399

(22) Filed: Jul. 11, 2001

(65) Prior Publication Data

US 2003/0012924 A1 Jan. 16, 2003

(51) Int. Cl.[7] ..... A47K 3/08; A47K 3/14; A47K 3/022; A47K 3/34; A47K 3/36; A47H 1/00; A47H 13/14; A47H 13/00; E06B 9/56

(52) U.S. Cl. ..... 4/558; 4/608; 4/610; D6/575; D6/578; 160/330; 160/348; 160/383; 160/DIG. 6

(58) Field of Search ..... 428/137, 187; 160/383, 330, 348, DIG. 6; 4/608, 558, 610; 24/716; D6/575, 578

(56) References Cited

U.S. PATENT DOCUMENTS

| | | | | | |
|---|---|---|---|---|---|
| 3,388,734 | A | * | 6/1968 | Silvestre | 160/348 |
| 4,202,059 | A | * | 5/1980 | Faragher, Jr. | 160/330 |
| D370,583 | S | * | 6/1996 | Fiddler | D6/575 |
| 6,189,597 | B1 | * | 2/2001 | Cheng | 160/330 |
| 6,336,232 | B1 | * | 1/2002 | Toder | 4/558 |

* cited by examiner

*Primary Examiner*—Harold Pyon
*Assistant Examiner*—Patricia L. Nordmeyer
(74) *Attorney, Agent, or Firm*—Robert L. Epstein; Harold James; James & Franklin, LLP

(57) ABSTRACT

The header is heat sealed along the top of one side of the liner body with both ends extending beyond the edges of the liner body. The ends of the header are folded around the edges of the liner body to a position parallel to the other side of the liner and heat sealed. Grommets are mounted through the liner and header portions such that the hook receiving openings at the corners of the liner are re-enforced.

14 Claims, 4 Drawing Sheets

FIG 5
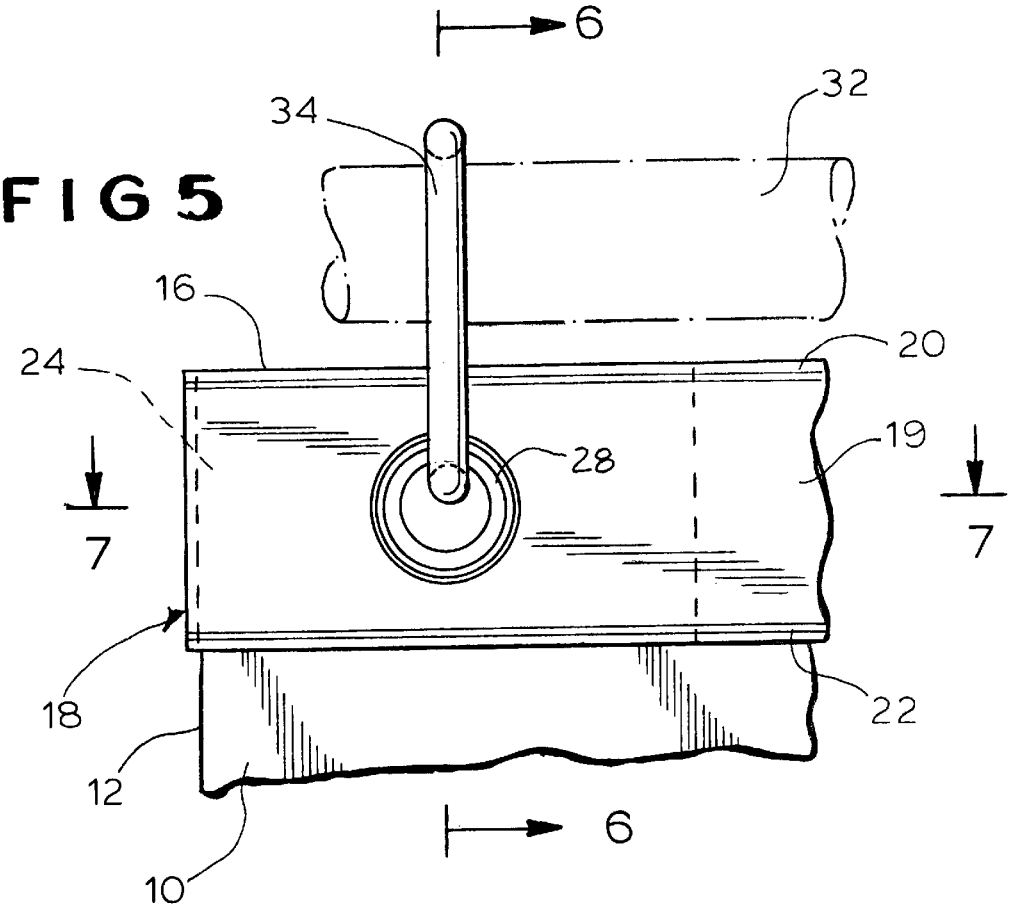
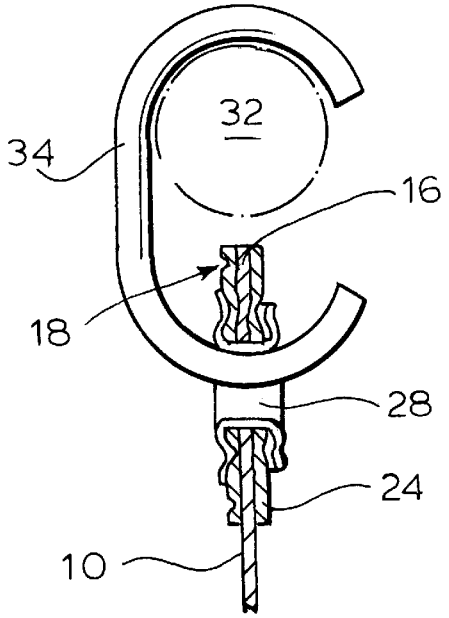
FIG. 6

RE-ENFORCED SHOWER CURTAIN LINER AND METHOD FOR FABRICATING SAME

The present invention relates to liners for shower curtains and in particular to a shower curtain liner with a re-enforced header and a method for fabricating same.

Plastic shower curtain liners are frequently used to protect shower curtains from water damage and the accumulation of mineral deposits. The liners and shower curtains are hung side-by-side from a horizontal rod by a plurality of shower curtain rings or hooks. One part of each hook slideably engages the rod while another part extends through aligned hook receiving openings at the top of the curtain and liner.

Because the liner is made of a thin plastic sheet, the material surrounding the hook receiving openings tends to tear easily if the liner is pulled or grabbed. In order to make the liner more tear resistant, the material surrounding the openings along the top of the liner can be strengthened and/or a separate header in the form of an elongated plastic strip can be heat sealed along the top of the liner prior to forming the openings. Since the openings extend through the header as well as through the top of the liner, the double thickness reduces the tendency for the liner to tear.

However, it has been found that the hook receiving openings at the corners of the top of the liner, even if formed as indicated above, still tend to be vulnerable to tearing.

It is, therefore, a prime object of the present invention to provide a shower curtain liner in which the material surrounding the openings at the corners of the liner is re-enforced against tearing.

It is another object of the present invention to provide a re-enforce shower curtain liner in which the ends of the header are folded over to provide a double layer header at the corners of the liner.

It is another object of the present invention to provide a method for fabricating a re-enforced shower curtain liner.

In accordance with one aspect of the present invention, a shower curtain liner is provided, including a body and a header. The header includes a first portion extending across at least a portion of the top of the liner body and second portion situated in parallel relation to the first portion. Preferably, the liner body is situated between the header portions.

The liner body has an edge. The second header portion is proximate the body edge. A grommet is mounted through the first and the second header portions.

Preferably, the first and the second header portions are integral.

The first header portion includes an elongated strip with an edge. The strip edge is heat sealed to one side of the liner body. Preferably, the strip has a second edge, spaced from the first edge. The strip is heat sealed to the liner body along the second edge of the strip, as well. The grommet is situated through the first and second header portions, between the heat sealed edges of the header strip.

In accordance with another aspect of the invention, a shower curtain liner is provided having a body and a header. The header has a first portion extending across the top of the liner body and second and third portions. Each of the second and third portions are situated in parallel relation to different portions of the first header portion. Preferably, the liner body is situated between the header portions.

The body has first and second edges. The second and third header portions are located proximate the first and second body edges, respectively.

First and second grommets are mounted through the second and third header portions, respectively.

Preferably, the first, second and third header portions are integral.

In accordance with another aspect of the present invention, a method for fabricating a shower curtain liner is provided. The liner has a body with a top and an edge, and a header with an end portion. The method includes mounting the header along the top of the liner body with the end portion of the header extending beyond the edge of the body. The end portion of the header is folded to a position parallel to the mounted header portion and affixed adjacent the liner body.

A grommet is mounted through the header and the end portion.

In accordance with another aspect of the present invention, a method for fabricating a shower curtain liner is provided. The liner has a body with a top and first and second edges, and a header with first and second end portions. The method includes the steps of mounting the header along the top of the body, with the first and second end portions of the header extending beyond the edges of the body. The first and second header end portions are folded around the edges of the liner body to positions parallel to the header. The end portions are affixed adjacent the liner body.

First and second grommets are mounted through the first and second end portions, respectively.

To these and such other objects which may hereinafter appear, the present invention relates to a re-enforced shower curtain liner and a method for fabricating same, as set forth in detail in the following specification and recited in the annexed claims, taken together with the accompanying drawings, wherein like numerals refer to like parts, and in which:

FIG. 5 is a front elevational view of one corner of the liner of the present invention as it appears suspended from a hook;

FIG. 6 is a slide cross-sectional view taken along line 6—6 of FIG. 5.

Figure 1:
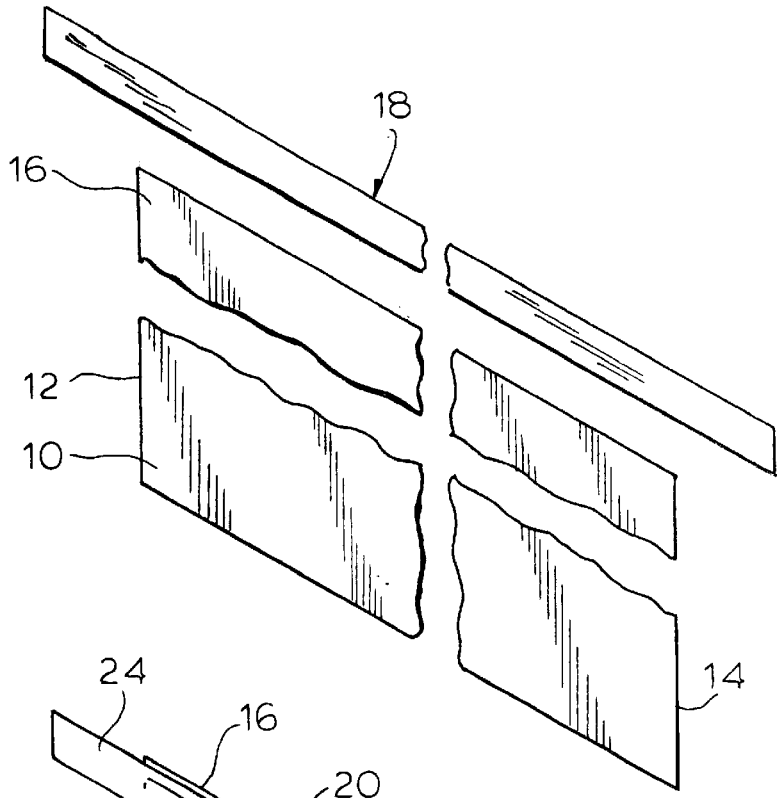
FIG. 1 is an exploded view of the parts of the shower curtain liner of the present invention showing same prior to assembly.

As seen in FIG. 1, the shower curtain liner of the present invention includes a body 10 formed of thin sheet of plastic material. Body 10 has edges 12, 14 and a top portion 16. The liner also includes a header, generally designated 18, formed of an elongated strip of plastic.

Figure 2:
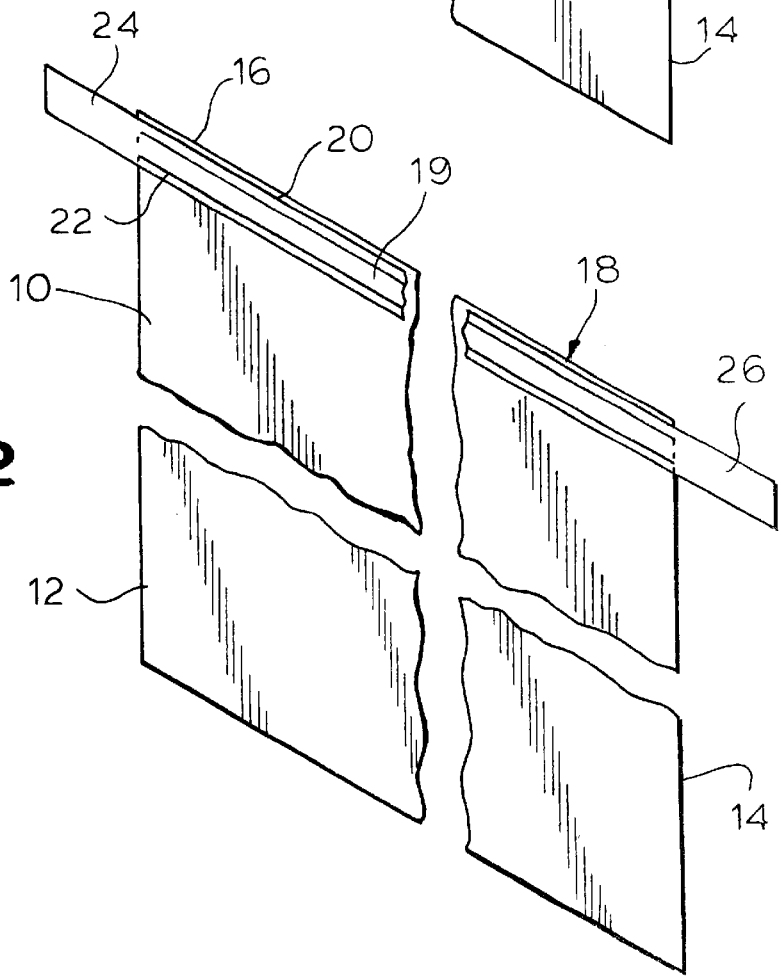
FIG. 2 is a view similar to FIG. 1, showing the header sealed to the liner body.
Figure 3:
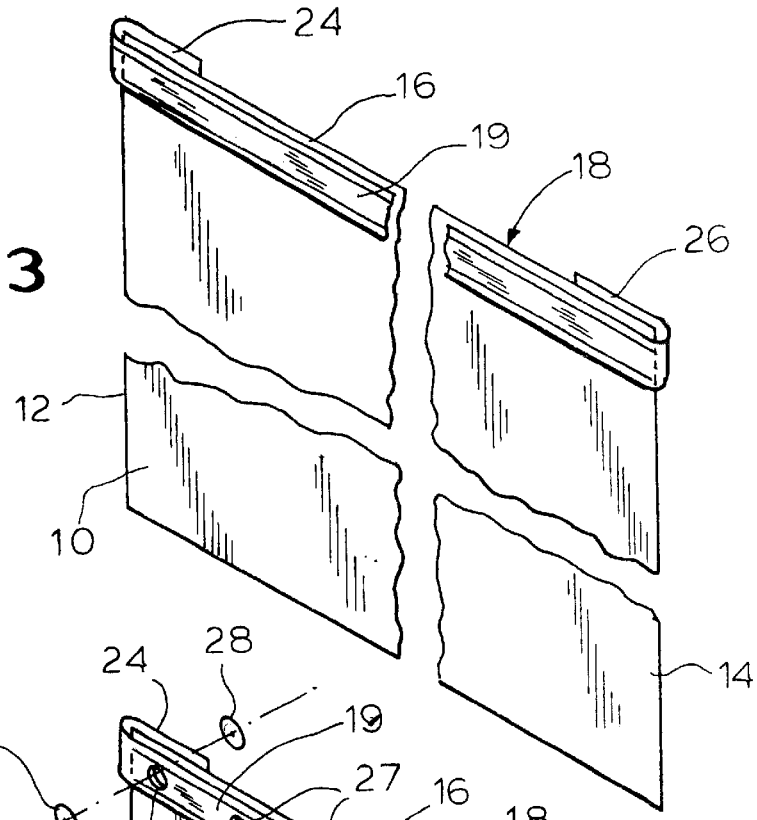
FIG. 3 is a view similar to FIG. 2, showing the end portions of the header folded around the edges of the liner body and sealed.
Figure 4:
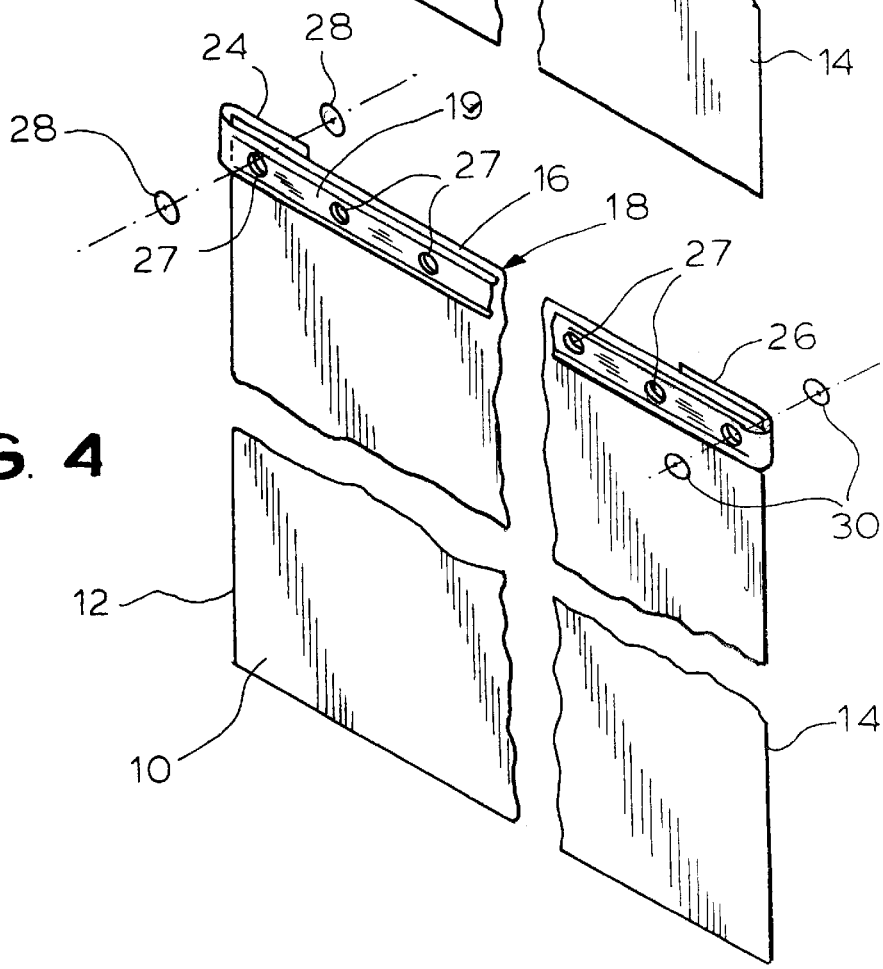
FIG. 4 is a view similar to FIG. 3, showing the hook receiving openings formed and the grommets, prior to mounting.

The main portion 19 of header 18 is heat sealed adjacent its top and bottom edges 20, 22 to top portion 16 of the liner, except at end portions 24, 26 which, as seen in FIG. 2, extend beyond edges 12, 14. As seen in FIG. 3, end portions 24, 26 are folded around edges 12, 14 into positions parallel to the mounted portion 19 of the header, at the corners of the liner. End portions 24, 26 are heat sealed to the side of liner 10 opposite to which main portion 19 of the header is sealed. As seen in FIG. 4, hook receiving openings 27 are formed and grommets 28, 30 made of metal or PVC, are mounted through each end portion 24, 26 and the adjacent mounted main 19 portion of the header, respectively, to re-enforce the top of the liner at each corner.

Figure 7:
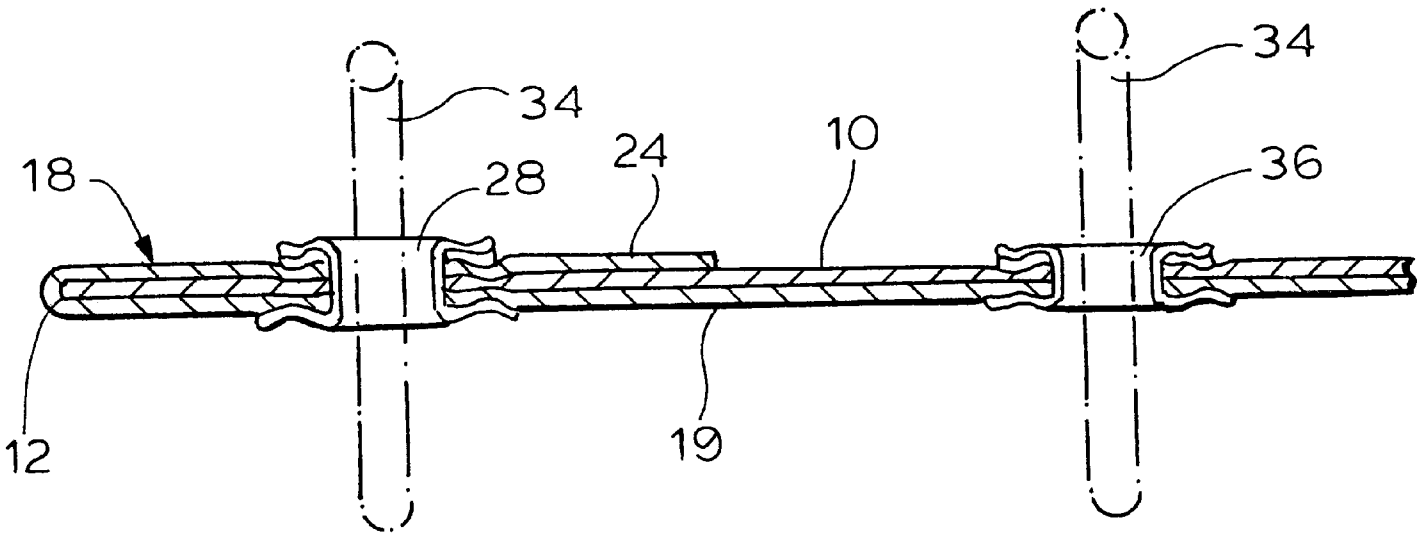
FIG. 7 is a top cross-sectional view taken along line 7—7 of FIG. 5.

As seen in FIGS. 5, 6 and 7, the shower curtain liner, fabricated as described above, is suspended from shower curtain rod 32 by hooks 34 which are received in openings 27 and grommets 28, 30 where present. Additional grommets 36 (FIG. 7) may be present in openings 27 across the entire header, if desired.

It will now be appreciated that the liner of the present invention is fabricated by heat sealing the header to the top portion of the liner with each of the end portions extending a few inches beyond the edge of the liner. The end portions are then folded around the liner edges to a position parallel to the sealed header and heat sealed in place. Hook receiving openings are formed. Grommets are then mounted through the header and the adjacent end portions, respectively, to re-enforce the corners of the liner. In this manner, the corners of the shower curtain liner are re-enforced against tearing in a simple, inexpensive way.

While only a single preferred embodiment of the present invention has been disclosed herein for purposes of illustration, many variations and modifications could be made thereto. It is intended to cover all of these variations and modifications which fall within the scope of the present invention as defined by the following claims:

I claim:

1. A shower curtain liner comprising a body with first and second opposite side edges and a header, said header comprising a first portion extending along the top of said liner body proximate one of side edges and a second portion, said second portion is situated in a parallel relation to said first portion, with said body there between, said first portion and said second portion are connected by a portion extending around said one of said side edges of said body.

2. A shower curtain liner comprising a body with first and second opposite side edges and a header, said header comprising a first portion extending across the top of said liner body from one of said side edges to the other of said side edges, and second and third portions, each of said second and third portions portion are situated in parallel relation to said first portion, with the body there between, said first portion and said second portion portion are connected by a portion extending around one of said side edges of said body and said first portion and said third portion portion are connected by a portion extending around the other of said side edges of said body.

3. A method for fabricating a shower curtain liner comprising a body with a top and a side edge, and a header with an end portion, said method comprising mounting said header along said top of said body with said end portion extending beyond said side edge, folding said end portion around said side edge of said body to a position parallel to said mounted header and affixing said folded end portion adjacent to said liner body.

4. A method for fabricating a shower curtain liner comprising a body with a top and first and second side edges, and a header having first and second end portions, said method comprising the steps of mounting said header along said top of said body with first and second end portions extending beyond said first and second side edges of said body, respectively, folding said first and second end portions around said respective side edges of said body to positions parallel to said mounted header and affixing said folded end portions adjacent to said liner body.

5. The liner of claim 1 further comprising a grommet mounted through said first and said second header portions.

6. The liner of claim 1 wherein said first and said second header portions are integral.

7. The liner of claim 1 wherein said first header portion comprises an elongated strip with a first edge and wherein said strip is heat sealed to said body along said first edge of said strip.

8. The liner of claim 7 wherein said strip has a second edge spaced from said first edge and wherein said strip is also heat sealed to said body along said second edge of said dip.

9. The liner of claim 8 further comprising a grommet situated through said first and said second header portions, between said first and second edges of said strip.

10. The liner of claim 2 wherein said liner body is situated between said first header portion and each of said second and third header portions.

11. The liner of claim 2 further comprising first and second grommets mounted through said second and third header portions, respectively.

12. The liner of claim 2 wherein said first, second and third header portions are integral.

13. The method of claim 3 further comprising the step of mounting a grommet through said end portion.

14. The method of claim 4 further comprising the step of mounting first and second grommets through said first and second end portions, respectively.

* * * * *